US006002204A

United States Patent [19]

Beeteson et al.

[11] Patent Number: 6,002,204

[45] **Date of Patent: *Dec. 14, 1999**

[54] DISPLAY DEVICE

[75] Inventors: John Beeteson, Skelmorlie; Andrew Ramsay Knox, Kilbirnie, both of United Kingdom

[73] Assignee: International Business Machines Corporation, Armonk, N.Y.

[ * ] Notice: This patent is subject to a terminal disclaimer.

[21] Appl. No.: 08/871,045

[22] Filed: Jun. 9, 1997

[30] Foreign Application Priority Data

Feb. 22, 1997 [GB] United Kingdom ..... 9703741

[51] Int. Cl.[6] ..... H01J 29/00

[52] U.S. Cl. ..... 313/495; 313/496; 313/497; 313/153; 313/154

[58] Field of Search ..... 313/495, 496, 313/497, 433, 442, 153, 154, 160

[56] References Cited

U.S. PATENT DOCUMENTS

| | | | |
|---|---|---|---|
| 3,136,910 | 6/1964 | Kaplan . | |
| 4,162,422 | 7/1979 | Morimoto et al. | 313/496 |
| 4,164,683 | 8/1979 | Nakamura et al. | 313/496 |
| 4,178,593 | 12/1979 | Kishino et al. | 340/753 |
| 4,217,578 | 8/1980 | Inami et al. | 340/754 |
| 5,172,028 | 12/1992 | Watanabe | 313/495 |
| 5,889,363 | 3/1999 | Beeteson | 313/495 |

FOREIGN PATENT DOCUMENTS

| | | |
|---|---|---|
| 0018688 | 11/1980 | European Pat. Off. . |
| 60-93742 | 5/1985 | Japan . |
| WO08726 | 3/1997 | WIPO . |

*Primary Examiner*—Ashok Patel
*Attorney, Agent, or Firm*—Bernard D. Bogdon

[57] ABSTRACT

A display device comprises a cathode means for emitting electrons and a permanent magnet having a two dimensional array of channels extending between opposite poles of the magnet. The magnet generates, in each channel, a magnetic field for forming electrons from the cathode means into an electron beam. A screen receives an electron beam from each channel, the screen having a phosphor coating facing the side of the magnet remote from the cathode, the phosphor coating comprising a plurality of areas, each area being capable of illumination, at least one of the areas being capable of illumination by a plurality of the electron beams. Grid electrode means are disposed between the cathode means and the magnet for controlling flow of electrons from the cathode means into each channel, the grid electrode means comprising a plurality of elements each element corresponding to a different area of the phosphor capable of illumination. First anode means is disposed between the magnet and the screen for accelerating the electron beam towards the screen.

1 Claim, 2 Drawing Sheets

DISPLAY DEVICE

FIELD OF THE INVENTION

The present invention relates to a magnetic matrix display device and more particularly to a fixed format display for use in laboratory equipment, car dashboards, flight cockpits and the like.

BACKGROUND OF THE INVENTION

Fixed format displays are displays where the changes in displayed information are achieved by the selective illumination of portions of the display, possibly in different colors. A fixed format display, unlike a general purpose display is usually only useable for a particular application. A limited control function, typically only the display brightness is provided.

SUMMARY OF THE INVENTION

In accordance with the present invention, there is now provided a display device comprising cathode means for emitting electrons, a permanent magnet, a two dimensional array of channels extending between opposite poles of the magnet, the magnet generating, in each channel, a magnetic field for forming electrons from the cathode means into an electron beam, a screen for receiving an electron beam from each channel, the screen having a phosphor coating facing the side of the magnet remote from the cathode, the phosphor coating comprising a plurality of areas, each area being capable of illumination, at least one of the areas being capable of illumination by a plurality of the electron beams, grid electrode means disposed between the cathode means and the magnet for controlling flow of electrons from the cathode means into each channel, the grid electrode means comprising a plurality of elements each element corresponding to a different area of the phosphor capable of illumination, and first anode means disposed between the magnet and the screen for accelerating the electron beam towards the screen.

At least one area of the phosphor being capable of illumination by a plurality of the electron beams means that area of phosphor can be thought of as having multiple electron beams associated with it, all of the associated electron beams being present together or none of the electron beams being present. The individual beams are not separately addressable. Areas of phosphor having a plurality of electron beams associated with them can be mixed with areas having a single electron beam associated with them.

In preferred embodiments of the invention, each of the areas of phosphor capable of illumination corresponds to a plurality of electron beams. The plurality of electron beams, although generated in separate channels in the magnet, are controlled by a single grid electrode means and are either all allowed into or all blocked from the channels.

The cathode means may be present over substantially all of the substrate on which it is located or it may be present only in those areas corresponding to the areas of phosphor.

Each of the phosphor areas may produce visible light of the same color, that is the display of the present invention corresponds to a monochrome display, which may be, for example, green, white, amber or any color in which phosphors are available. In the alternative, some of the phosphor areas may emit visible light of a different color to others of the phosphor areas, that is the display of the present invention is more similar to a color display. The display of the present invention differs in front of screen appearance and function from a conventional display in that each of the phosphor areas on the screen is only ever capable of displaying a single color. However, phosphor areas of any of the colors of phosphor which are available can be used.

The display of the present invention is particularly suited for use in vehicles, such as in a car dash board or in an aircraft flight cockpit.

The present invention also provides a computer system comprising memory means, data transfer means for transferring data to and from the memory means, processor means for processing data stored in the memory means, and a display device as for displaying data processed by the processor means.

BRIEF DESCRIPTION OF THE DRAWINGS

Preferred embodiments of the present invention will now be described, by way of example only, with reference to the accompanying drawings in which.

DETAILED DESCRIPTION OF THE PREFERRED EMBODIMENTS

An embodiment of the invention will now be described by means of an example application of the invention to a temperature gauge. The display is required only to display information in a fixed format, in this case to illuminate one of a number of colored segments of the display. The color of the segment and its relative position indicate the temperature. Blue segments are used to represent cold, green segments are used to represent normal, yellow segments are used to represent caution and red segments are used to represent warning. Within the areas of segments of each color, the position of the segment which is illuminated also conveys information. For example, if a green segment which is immediately adjacent to the yellow segments is illuminated, then although the temperature is normal, any increase will result in a yellow caution segment being displayed. The intensity of the illumination of the segment is controlled to compensate for, for example, the ambient illumination level and user preferences. The segment may be singly lit with all others extinguished, or may be brightly lit, with all others dimly lit, that is there is enhanced contrast for the active segment.

Figure 1:
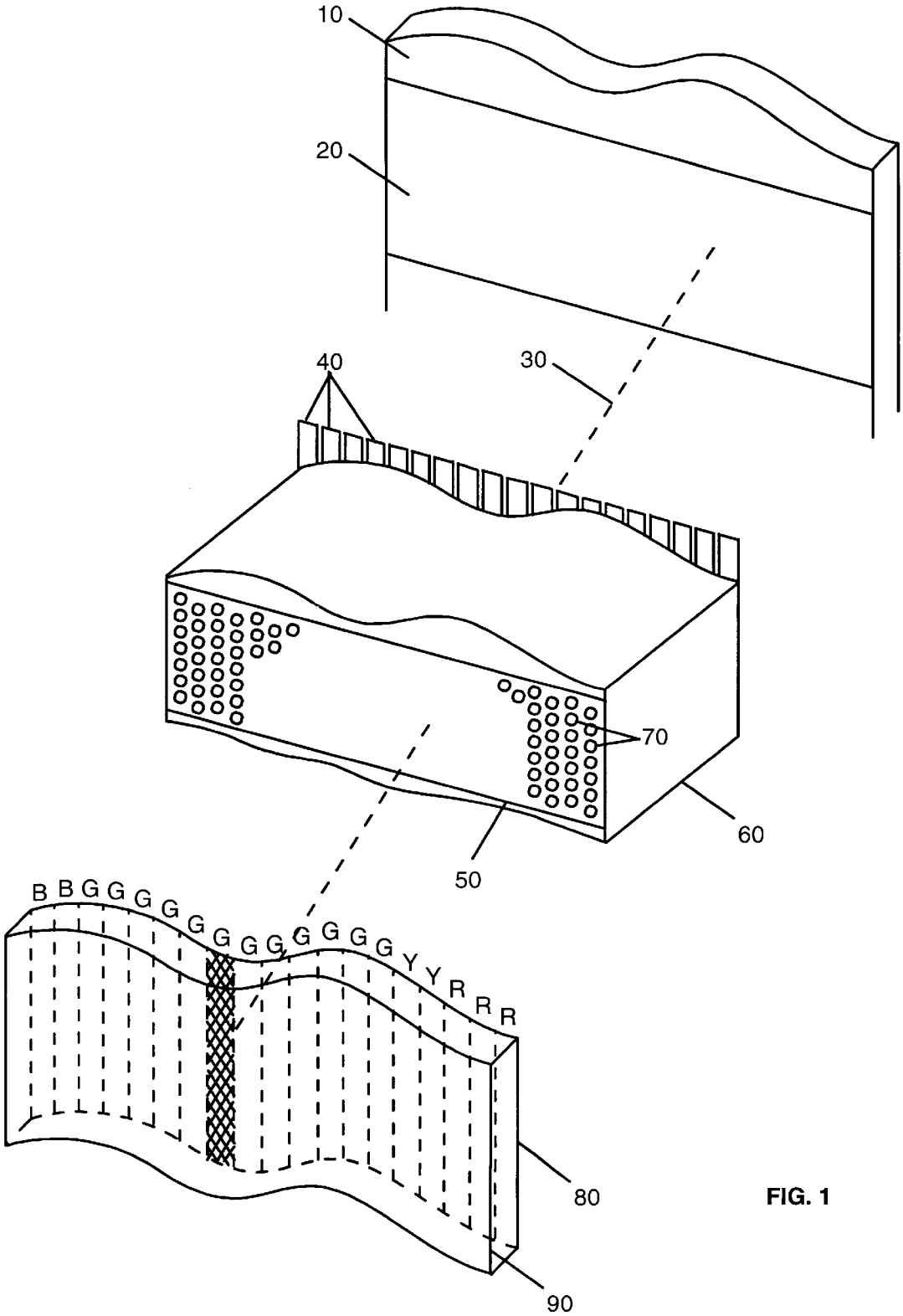
FIG. 1 is an exploded diagram of a display embodying the present invention.

Referring first to FIG. 1, a magnetic matrix display of the present invention comprises a first glass plate 10 carrying a uniform area cathode 20, covering the entire display area and a second glass plate 90 carrying a coating of phosphor stripes 80 facing the cathode 20. In another embodiment, the area cathode 20 is only present on the glass plate 10 in regions where electron beam current is required. The phosphors are preferably high voltage phosphors. The phosphor stripes may all be the same color or they may of different colors arranged according to the desired output required on the display. Unlike a conventional display which has three primary colored phosphors which are mixed in various proportions to produce the range of colors available, the color of the light output is dictated by the color of light the particular phosphor produces.

In the example of FIG. 1, the phosphors are arranged as a row of two blue phosphor stripes, twelve green phosphor stripes, two yellow phosphor stripes and three red phosphors. A final anode layer (not shown) is disposed on the phosphor coating 80 and is connected to an EHT supply to provide the electron beam with sufficient energy to cause efficient usage of the electron beam current in producing visible light from the phosphors. A permanent magnet 60 is disposed between glass plates 90 and 10. The magnet is perforated by a two dimension matrix of perforations or "pixel wells" 70. An anode 50 is formed on the surface of the magnet 60 facing the phosphors 80. For the purposes of explanation of the operation of the display, this surface will be referred to as the top of the magnet. This anode covers the entire top side of the magnet and the voltage which is applied to this anode enables the anode to provide the field gradient to accelerate the electrons through the pixel wells and allows the anode to operate in conjunction with the grid electrodes to attract electrons into the pixel wells.

A plurality of control grid stripes 40 are formed on the surface of the magnet 60 facing the cathode 20. For the purposes of explanation of the operation of the display, this surface will be referred to as the bottom of the magnet. The control grid stripes 40 comprise a group of parallel control grid conductors extending across the magnet surface in a column direction so that each phosphor stripe 80 is associated with a control grid stripe and with one or more of the perforations or "pixel wells" 70 in the magnet. The control grid stripes 40 could be arranged in a row direction, or arranged as areas, but will always correspond to areas of the phosphor with which they are associated.

Plates 10 and 90, and magnet 60 are brought together, sealed and then the whole is evacuated. In operation, electrons are released from the cathode and attracted towards control grid stripe 40. Control grid stripe 40 provides an addressing mechanism for selectively admitting electrons to pixel wells 70 in the magnet corresponding to each of the phosphor stripes. The voltage applied to each of the control grid stripes is switched between a non-select level where electrons are blocked from entering the pixel wells and an "on" level where the electrons are allowed to enter the pixel wells. Electrons pass through grid 40 into a pixel well 70. In each pixel well 70, there is an intense magnetic field. The anode 50 at the top of pixel well 70 accelerates the electrons through pixel well 70. Electron beam 30 is then accelerated towards a higher voltage anode formed on glass plate 90 to produce a high velocity electron beam 30 having sufficient energy to penetrate the anode and reach the underlying phosphors 80 resulting in light output. The higher voltage anode may typically be held at 10 kV.

Figure 2:
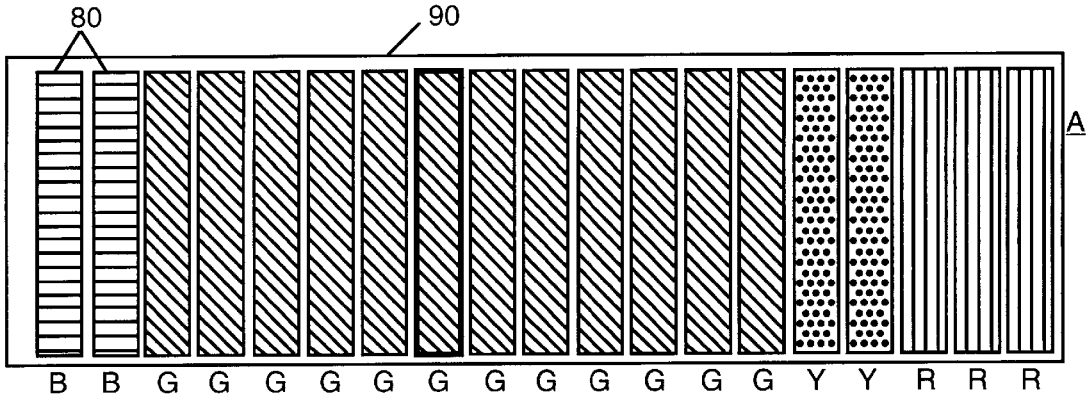
FIG. 2 is a view of a glass faceplate of the display of FIG. 1 carrying a coating of colored phosphor stripes.
Figure 4:
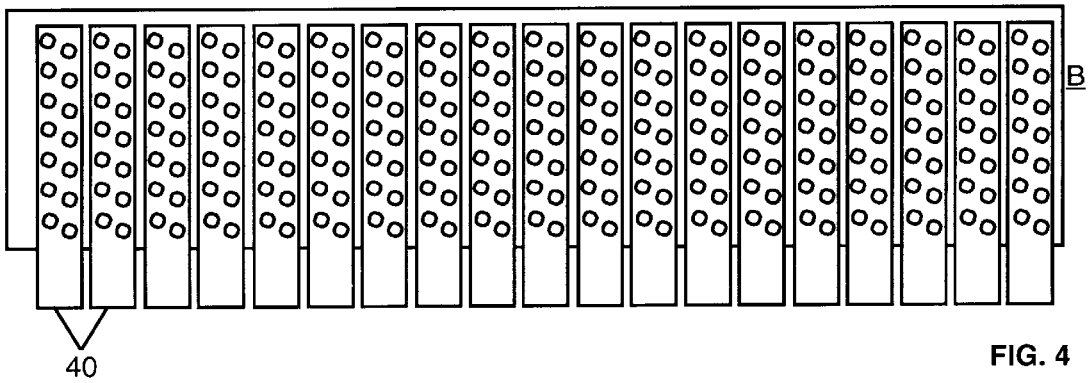
FIG. 4 is a view of a control grid conductors of the display of FIG. 1.
Figure 3:
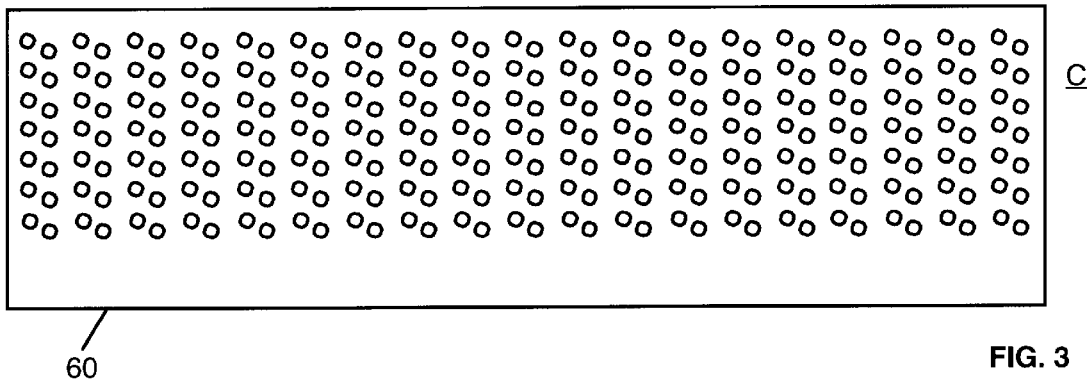
FIG. 3 is a view of a magnet of the display of FIG. 1.

FIGS. 2 to 4 show components of the display as viewed from the front of the display seen by the user. FIG. 2 shows the glass plate 90 having phosphor stripes 80. In the embodiment shown, there are two blue stripes, twelve green stripes, two yellow stripes and three red stripes. The green stripe sixth from the left is shown highlighted, since this is the "active" zone or the one presently illuminated.

FIG. 3 shows the magnet used. The magnet is perforated with pixel wells, each pixel well corresponding to an electron beam and groups of adjacent pixel wells and their respective electron beams being associated with each of the phosphor stripes. The patterning of pixel wells in the magnet corresponds to the patterning of the first anode 50 on the surface of the magnet facing the phosphor coated glass plate.

FIG. 4 shows the grid conductors 40 laid out in strips with numerous apertures for each segment corresponding to pixel wells in the magnet. A connection is provided to each of the grid conductors 40 for a control voltage to be applied to each of the grid conductors. The control voltage is modulated to control the beam current entering that pixel well 70. Controlling the beam current controls the number of electrons subsequently striking the colored phosphor stripe 80 with which the grid electrode 40 is associated and hence the intensity with which the phosphor stripe 80 is illuminated.

Figure 5:
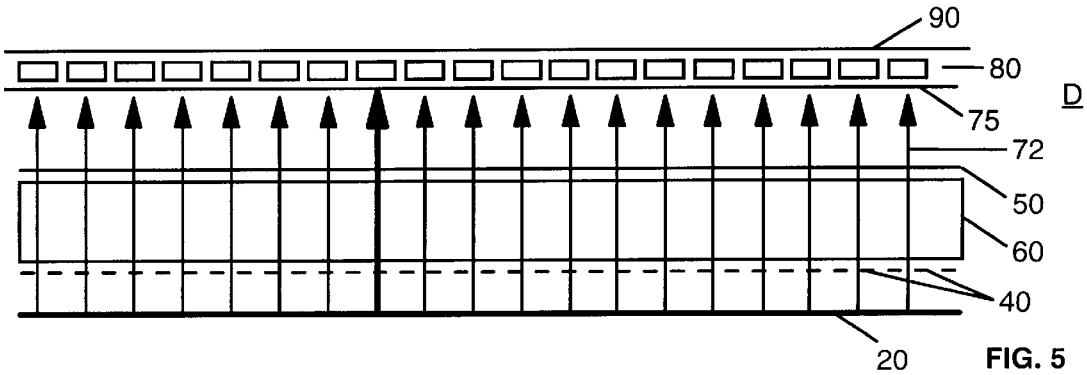
FIG. 5 is a cross-section view of the display of FIG. 1.

FIG. 5 shows a section through the display of FIG. 1 including the phosphor coated glass screen of FIG. 2, the magnet of FIG. 3 and the grid conductors of FIG. 4. In FIG. 5, one of the areas of phosphor is shown brightly lit, with the other areas of phosphors shown dimly lit. Starting from the rear of the display, the cathode 20 is shown having electrons leaving it, the flow of those electrons being controlled by grid electrodes 40, which either allow or block the entry of electrons into the pixel wells 70 formed in the magnet 60. The electron beams which are allowed into the pixel wells 70 in the magnet 60 are attracted to a first anode 50 located on the front surface of the magnet. After exiting the pixel wells the electrons are attracted to a final anode 75 which consists of an aluminum backing to the colored phosphor stripes 80. This aluminum backing 75 is connected to an EHT supply and provides the electrons with sufficient energy to produce visible light output from the colored phosphors. At the front of the display is the glass plate 90 carrying the phosphor stripes 80.

Unlike a general purpose display, a matrix addressing technique is not used for a display according to the present invention. Thus the duty cycle of electrons hitting the phosphor stripes is 100%. This contrasts with a general purpose matrix addressed display having 1280 pixels horizontally and 1024 pixels vertically which has a duty cycle of less than 0.1%. The beam current required for a given light output is reduced by the ratio of the duty cycle. For a general purpose matrix addressed display, a light output of 100 Cd/m2 requires in the region of 200 nA per pixel with a duty cycle of 0.1%. In a display according to the present invention, the beam current required for the same light output is only 200 pA, that is one thousandth part of that required for a matrix addressed display.

When a display is used in an office environment, the ambient light range is typically 500 to 1000 lux. This corresponds to 156 to 318 Cd/m2 from a perfect diffusing source. A display light output of 100 Cd/m2 is sufficient to maintain a high enough contrast ratio between "active" and "inactive" display segments.

However, when a display is used in, for example, a car dashboard, the ambient light range experienced is far greater than in an office environment. On a bright sunlit day the ambient light may be 10,000 lux, whilst at night it may be only 10 lux. This range corresponds to 3183 to 3 Cd/m2 from a perfect diffusing source, a very wide range of ambient illumination over which the display must operate. A high contrast ratio between "active" and "inactive" display segments is needed. Hence a range of required light outputs from the display of 1 to 1000 Cd/m2 is needed, corresponding to beam currents of 2 pA to 2 nA for a display according to the present invention.

Although the present invention and its advantages have been described in detail, it should be understood that various changes, substitutions and alterations can be made herein without departing from the spirit and scope of the invention as defined by the appended claims.

That is claim:

1. A computer system including; memory means, data transfer means for transferring data to and from the memory means, processor means for processing data stored in the memory means, and a display device included within an evacuated housing for displaying data processed by the processor means, comprising:

cathode means for emitting electrons;

a permanent magnet;

a two dimensional array of channels extending between opposite poles of the magnet;

the magnet generating, in each channel, a magnetic field for forming electrons from the cathode means into an electron beam;

a screen for receiving an electron beam from each channel, the screen having a phosphor coating facing the side of the magnet remote from the cathode, the phosphor coating comprising a plurality of areas, each area being capable of illumination, at least one of the areas is for illumination by a plurality of the electron beams;

grid electrode means disposed between the cathode means and the magnet for controlling a flow of electrons from the cathode means into each channel, the grid electrode means comprising a plurality of elements each element is directly associated with a different area of the phosphor for illumination; and first anode means disposed between the magnet and the screen for accelerating the electron beam towards the screen.

* * * * *